US009534863B2

(12) United States Patent
Maier et al.

(10) Patent No.: US 9,534,863 B2
(45) Date of Patent: Jan. 3, 2017

(54) ELECTROMAGNETIC DEVICE AND METHOD TO ACCELERATE SOLID METAL SLUGS TO HIGH SPEEDS

(71) Applicant: The United States of America, as represented by the Secretary of the Navy, Washington, DC (US)

(72) Inventors: William Bryan Maier, Marina, CA (US); Eugene Ellis Nolting, Columbia, MD (US); Gene Morris, Seaside, CA (US); Donald D. Snyder, Monterey, CA (US); George Ralph Caramico, Virginia Beach, VA (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 217 days.

(21) Appl. No.: 13/662,786

(22) Filed: Oct. 29, 2012

(65) Prior Publication Data

US 2016/0054093 A1 Feb. 25, 2016

Related U.S. Application Data

(60) Provisional application No. 61/554,367, filed on Nov. 1, 2011.

(51) Int. Cl.
*F41B 6/00* (2006.01)
*F42B 6/00* (2006.01)

(52) U.S. Cl.
CPC ..... *F41B 6/006* (2013.01); *F41B 6/00* (2013.01); *F42B 6/006* (2013.01)

(58) Field of Classification Search
USPC 124/3; 89/8, 1.814–1.816; 310/12.01–12.33; 318/135
See application file for complete search history.

(56) References Cited

U.S. PATENT DOCUMENTS 667,435 A * 2/1901 Friese-Greene et al. ..... 102/375
4,534,263 A 8/1985 Heyne et al.
(Continued)

OTHER PUBLICATIONS

Sivkov, A.A., "Hybrid Electromagnetic System for Acceleration of Solids." Journal of Applied Mechanics and Technical Physics, vol. 42, pp. 1-9, 2001.

*Primary Examiner* — Stephen M Johnson
*Assistant Examiner* — Benjamin Gomberg
(74) *Attorney, Agent, or Firm* — Naval Postgraduate School; James B. Potts; Lisa A. Norris

(57) ABSTRACT

A device and method to accelerate solid metal slugs to high speeds. In one embodiment, a large electric current is passed through an outer cylindrical metal tube enclosing in part a metal slug, a central electrode, and a conducting tail coupled at opposite ends to the. metal slug and the central electrode. Electromagnetic forces accelerate the metal slug to a point high enough to mechanically separate the conducting tail. On separation, a plasma is generated by the passage of electric current though a gas produced by vaporization of the conducting tail and nearby materials. An insulator enclosed within the tube prevents the plasma from shorting to the outer tube until the current flow has produced a sufficient magnetic field to contain the plasma. The metal slug is then accelerated to high speed by a combination of electromagnetic forces and mechanical pressure from the hot gas through which the electric current is passing.

10 Claims, 3 Drawing Sheets

(56) References Cited

U.S. PATENT DOCUMENTS

| | | | | | |
|---|---|---|---|---|---|
| 4,715,261 | A | * | 12/1987 | Goldstein et al. | 89/8 |
| 4,913,029 | A | * | 4/1990 | Tidman et al. | 89/8 |
| 4,967,637 | A | | 11/1990 | Loffler et al. | |
| 5,005,484 | A | * | 4/1991 | Witt | 102/501 |
| 5,042,359 | A | * | 8/1991 | Witt et al. | 89/8 |
| 5,094,141 | A | * | 3/1992 | Zwingel et al. | 89/8 |
| 5,115,743 | A | | 5/1992 | Loffler | |
| 5,171,932 | A | | 12/1992 | McElroy | |
| 5,331,879 | A | * | 7/1994 | Loffler | 89/8 |
| 5,503,058 | A | | 4/1996 | Marinos | |
| 5,503,081 | A | | 4/1996 | Lindblom et al. | |
| 5,546,844 | A | | 8/1996 | Krumm et al. | |
| 5,612,506 | A | * | 3/1997 | Goldstein | 102/472 |
| 5,688,416 | A | | 11/1997 | Johnson | |
| 5,854,439 | A | | 12/1998 | Almstrom et al. | |
| 6,119,599 | A | | 9/2000 | Johnson et al. | |
| 8,746,120 | B1 | | 6/2014 | Nolting et al. | |
| 8,810,121 | B1 | | 8/2014 | Maier, II et al. | |

* cited by examiner

ELECTROMAGNETIC DEVICE AND METHOD TO ACCELERATE SOLID METAL SLUGS TO HIGH SPEEDS

CROSS-REFERENCE TO RELATED APPLICATIONS

This application claims the benefit of U.S. Provisional Application No. 61/554,367 filed Nov. 1, 2011, which is hereby incorporated in its entirety by reference.

BACKGROUND OF THE INVENTION

1. Field of the Invention

The present invention relates generally to electromagnetic acceleration of metal projectiles.

2. Description of the Related Art

High velocity metal slugs have a variety of uses, but rather large and complicated facilities, e.g. staged gas guns, are required to produce speeds of over about 1 km/s. Chemical propellants ignite and produce a high pressure gas that pushes metal slugs out of gun barrels. The speed that can be achieved is limited by the speed of sound in the combustion products, which may reach a few thousand degrees Kelvin (K). Speeds nearing 1.2 km/s have been achieved in some prior art systems but are not normally reached. Prior art railguns routinely accelerated projectiles to speeds greater than 1.2 km/s; however, railgun barrel construction is complicated and expensive, and the barrel lifetime is limited. In prior art railgun systems, immense forces push the rails apart, and very strong containment is required; insulators are utilized to separate the conducting rails, and large power supplies are required.

SUMMARY OF THE INVENTION

Embodiments in accordance with the invention described herein accelerate solid metal slugs to high speeds using a combination of electromagnetic forces and gas pressure. In accordance with one embodiment, a tubular electromagnetic (EM) launcher device includes: a cylindrical metal tube having an outer diameter and an inner diameter and a central channel; a metal slug disposed within the central channel; a conducting central electrode disposed within the central channel; a conducting tail where a first portion of the conducting tail is attached within the metal slug, a second portion of the conducting tail extends between the metal slug and the central electrode, and a third portion of the conducting tail extends within the central electrode; an insulator disposed within the central channel and surrounding at least a portion of the conducting central electrode and the second portion of the conducting tail; a first conductive plate in conductive contact with the central electrode; and a second conductive plate in conductive contact with the metal tube, wherein application of a current to the metal tube through the second conductive plate to the device causes the conducting tail to break with resultant generation of a plasma along a central axis of the central channel and generation of gas pressure and electromagnetic forces that accelerates the metal slug to a high speed.

In another embodiment, a method for accelerating a solid metal slug to a high speed by the device is also described.

Embodiments in accordance with the invention are best understood by reference to the following detailed description when read in conjunction with the accompanying drawings.

Embodiments in accordance with the invention are further described herein with reference to the drawings.

DETAILED DESCRIPTION OF THE INVENTION

Figure 1:
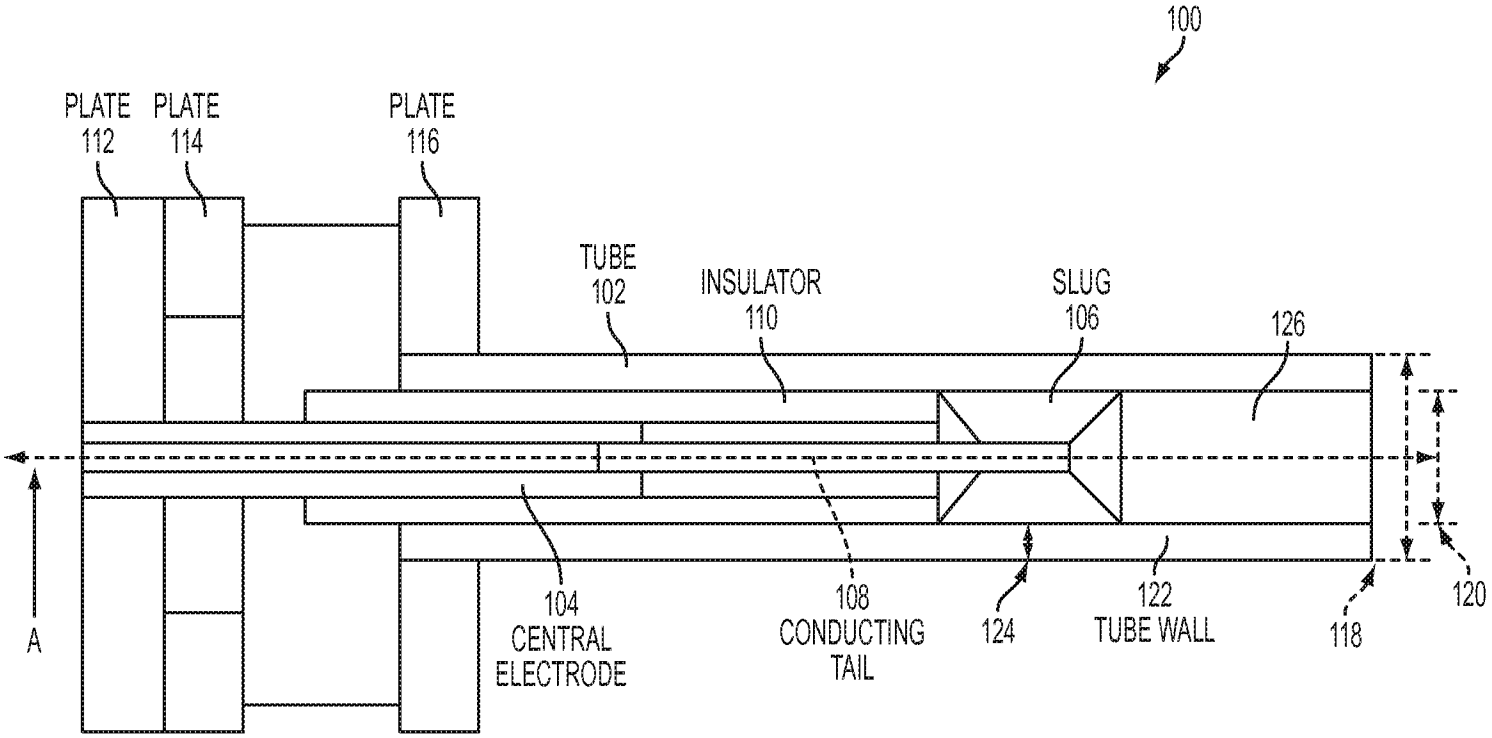
FIG. 1 illustrates a cross-sectional view of a schematic configuration of a tubular electromagnetic (EM) launcher device in accordance with one embodiment.

FIG. 1 illustrates a cross-sectional view of a schematic configuration of a tubular electromagnetic (EM) launcher device 100 in accordance with one embodiment. As illustrated in FIG. 1, tubular EM launcher 100 includes: a smooth cylindrical metal tube 102; a conducting central electrode 104; a conductive slug 106; a metallic conducting tail 108 that initially makes conductive contact between slug 106 and central electrode 104; a central insulator 110, and conducting plates 112, 114, and 116. Not shown are current carrying attachments which couple device 100 to a power supply capable of supplying current, such as several hundred kiloamperes of current. The power supply (not shown) is connected to the current carrying attachments and when initiated, provides power to device 100 via the current carry attachments. In one embodiment, a current carry attachments are connected at plates 112, 116 such that current flows from the power supply to device 100 at plate 116 and exits at plate 112.

Tube 102 has an exterior diameter 118 and interior diameter 120 resulting in a tube wall 122 with a wall thickness 124 and an interior channel 126 of diameter 120 having a central axis shown as A. In one embodiment tube 102 is formed of one or more metals. The metal selected should be strong enough to withstand large pressures produced within channel 126. Disposed within interior channel 126 is metal slug 106 which surrounds and is attached to conducting tail 108. In one embodiment, conducting tail 108 is formed of a conductive material.

In one embodiment a first portion of conducting tail 108 is seated in slug 106 and the remainder of conducting tail 108 extends from slug 106 through insulator 110 and partially into central electrode 104. In various embodiments, the shape of conducting tail 108 and slug 106 can be differently configured. Further insulator 110, can be differently configured, such that in some embodiments, insulator 110 can be deleted or cover part or all of interior channel 126. In some embodiments, insulator 110 can be differently shaped.

Figure 2:
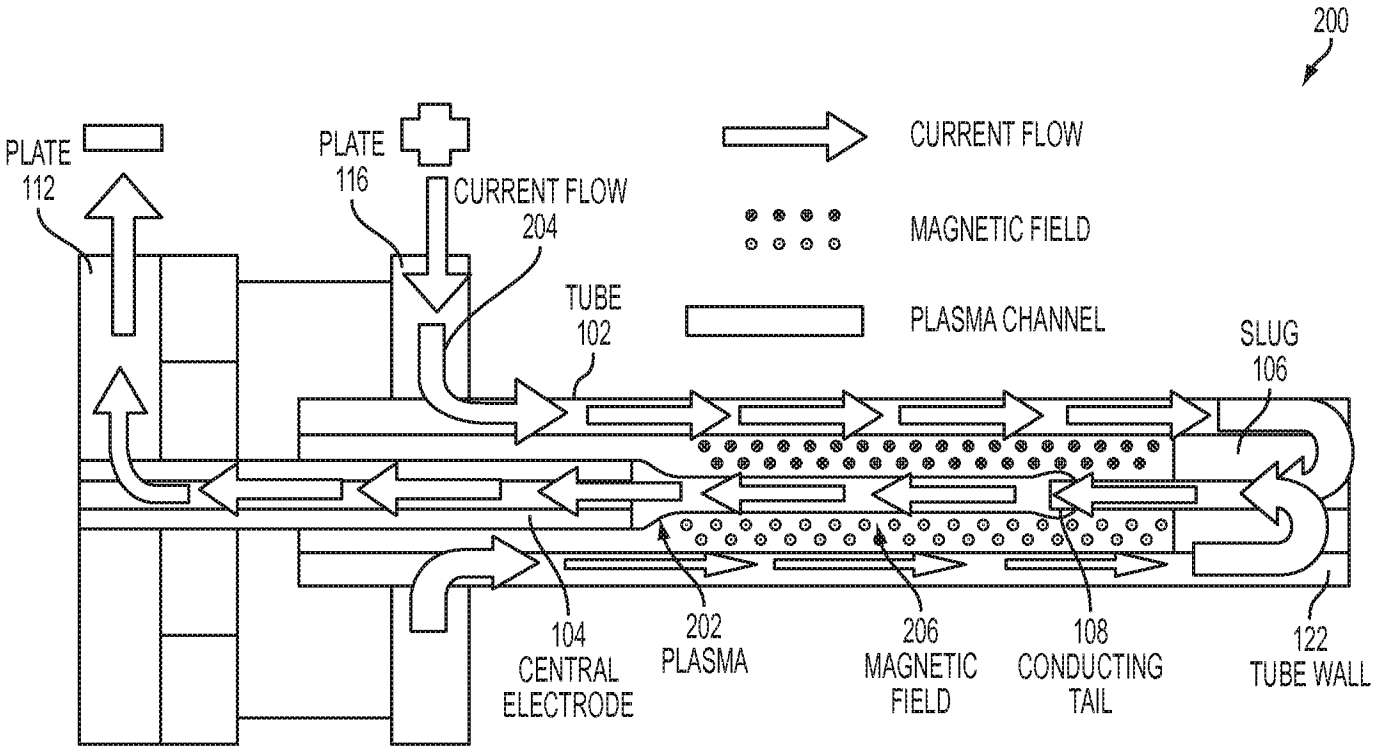
FIG. 2 illustrates a schematic depiction of a current flow in the tubular EM launcher device of FIG. 1 when a plasma is fully developed in accordance with one embodiment.

FIG. 2 illustrates a schematic depiction 200 of a current flow 204 in tubular EM launcher device 100 of FIG. 1 when a plasma 202 is fully developed in accordance with one embodiment. For clarity of description identifiers utilized in FIG. 1 are maintained in FIG. 2. In FIG. 2, application of current is from an external power supply (not shown) through current carrying attachments (not shown) coupled to device 100. For example, in one embodiment, current enters device 100 at plate 116, flows through device 100, and exits at plate 112. In one embodiment, when power is applied to tubular EM launcher device 100, electrical current flows from the power supply (not shown) via the electrical connectors (not shown) down the length of tube 102 to the position of slug 106, e.g. a projectile, through slug 106, back down a conducting path through the center of tube 102 to central electrode 104, and then back to the power supply (not shown). In some embodiments, the current flow in slug 106 is across back side of slug 106, e.g., the back side being the side of slug 106 facing central electrode 104.

When a voltage is applied to plates 112 and 116, a large current 204 flows, and slug 106 is accelerated by a force $F=L'I^2/2$, where I is the current and L' is a constant called the linear inductance gradient. The acceleration is large enough to mechanically separate conducting tail 108 and a very hot plasma arc, plasma 202, is formed between the two separated halves of conducting tail 108. Plasma 202 is generated by the passage of electric current through the gas produced by vaporization of the material of conducting tail 108 and nearby materials. The hot plasma arc, plasma 202, evaporates material of conducting tail 108 and produces a gas pressure that can be in excess of 20,000 psi. Further acceleration of slug 106 is accomplished by a combination of gas pressure and electromagnetic forces. In testing, slug speeds >1400 m/s have been produced by ≈20 cm of travel, i.e., with acceleration of slug 106 along a short cylindrical tube 102.

The current passing through plasma 202 produces an axial magnetic field 206. Axial magnetic field 206 encircles, e.g., surrounds, plasma 202 and inhibits flow to tube 102 resulting in plasma 202 formed as a plasma channel, e.g. a column, along the central axis of tube 102. Magnetic field 206 generated by the central current holds plasma 202 away from wall 122 of tube 102 and prevents plasma 202 from shorting to the side. Central insulator 110 prevents the initial stage of plasma 202 from shorting to wall 122 of tube 102 before a strong magnetic field is established.

The performance of device 100 is very sensitive to changes in the material and sizing of central electrode 104, conducting tail 106, insulator 110, and metal slug 106. In one embodiment, one or more conducting extensions can be added to slug 106 to alter performance characteristics as further illustrated with reference to FIG. 3.

Figure 3:
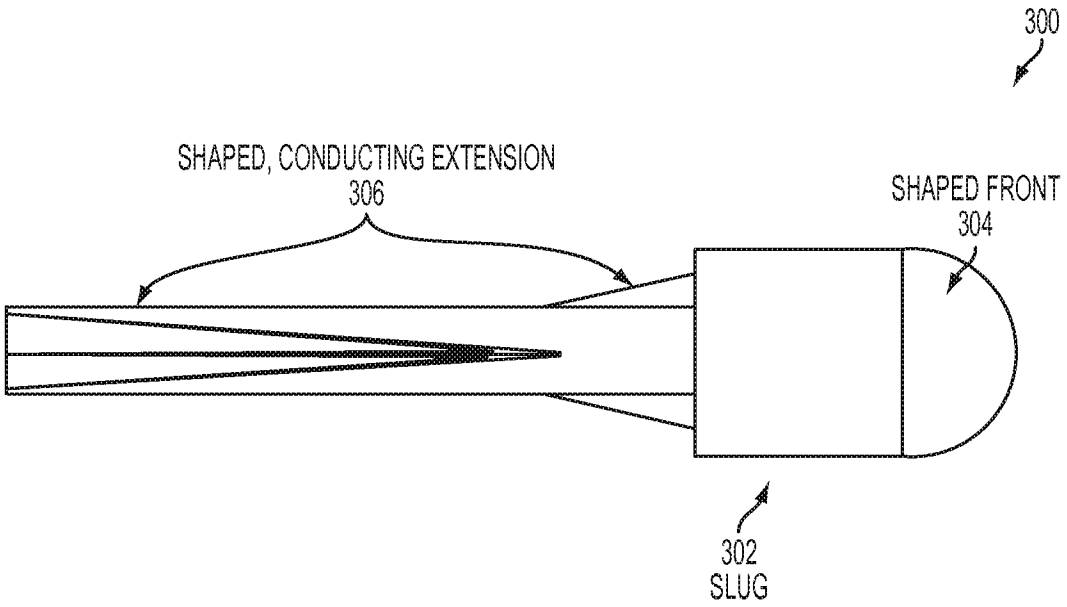
FIG. 3 illustrates a schematic depiction of a shaped conducting extension added to a metal slug in accordance with one embodiment.

FIG. 3 illustrates a schematic depiction of a shaped conducting extension added to a slug in accordance with one embodiment. As illustrated in FIG. 3, a metal slug 302 is configured to include a rounded shaped front 304 and a shaped conducting extension 306.

As described above, embodiments in accordance with the invention described herein accelerate solid metal slugs to high speeds using a combination of electromagnetic forces and gas pressure. This disclosure provides exemplary embodiments of the present invention. The scope of the present invention is not limited by these exemplary embodiments. Numerous variations, whether explicitly provided for by the specification or implied by the specification or not, may be implemented by one of skill in the art in view of this disclosure.

What is claimed is:

1. A tubular electromagnetic (EM) launcher device for accelerating solid metal slugs to high speeds comprising:

a cylindrical metal tube having an outer diameter and an inner diameter and having a tube wall between said outer diameter and said inner diameter, where said tube wall surrounds a central channel having a central axis;

a metal slug disposed within said central channel and in conductive contact with said tube wall, where said central axis of said central channel intersects said metal slug;

a central electrode disposed within said central channel where said central electrode is displaced from said tube wall;

a conducting tail where said conducting tail is displaced from said tube wall, where a first portion of said conducting tail is attached within said metal slug and in conductive contact with said metal slug, a second portion of said conducting tail extends between said metal slug and said central electrode, and a third portion of said conducting tail extends within said central electrode and is in conductive contact with said central electrode, and where said central axis of said central channel intersects said first portion of said conducting tail, said second portion of said conducting tail, and said third portion of said conducting tail;

a first conductive plate in conductive contact with said central electrode; and, a second conductive plate in conductive contact with said cylindrical metal tube, wherein application of a current to said metal tube through said second conductive plate results in said current passing through said cylindrical metal tube, through said metal slug, through said conducting tail, and through said central electrode causing said conducting tail to break with resultant generation of a plasma along said central axis of said central channel and generation of gas pressure, and further wherein said current passes through said plasma producing an axial magnetic field which encircles said plasma and inhibits flow of said plasma said cylindrical metal tube resulting in said plasma formed as a plasma channel displaced from said tube wall;

and further wherein said current passes through said plasma producing an electromagnetic force wherein said gas pressure and said electromagnetic force accelerate said metal slug to a high speed greater than or equal to 1000 m/s.

2. The tubular electromagnetic (EM) launcher device of claim 1 wherein said metal slug further comprises:

one or more conducting extensions.

3. The tubular electromagnetic (EM) launcher of claim 1 where some portion of said central electrode surrounds a portion of said central axis, and where said third portion of said conducting tail is in conductive contact with said central electrode at said some portion of said central electrode.

4. The tubular electromagnetic (EM) launcher of claim 3 further comprising an insulator disposed within said central channel where said insulator surrounds said portion of said central axis and separates said tube wall and said some portion of said conducting central electrode.

5. The tubular electromagnetic (EM) launcher of claim 1 further comprising said current passing through said cylindrical metal tube, through said metal slug, through said conducting tail, and through said conducting central electrode, wherein said current causes said metal slug to accelerate and the acceleration of said metal slug causes said conducting tail to break.

6. The tubular electromagnetic (EM) launcher of claim 5 where said current causes said metal slug to accelerate and the acceleration of said metal slug causes said conducting tail to break into a first half attached within said metal slug and a second half in conductive contact with said conducting central electrode, and said current causes a plasma arc to form between said first half and said second half.

7. A method for accelerating solid metal slugs to high speeds in a device comprising:

a cylindrical metal tube having an outer diameter and an inner diameter and having a tube wall between said outer diameter and said inner diameter, where said tube wall surrounds a central channel having a central axis;

a metal slug disposed within said central channel and in conductive contact with said tube wall, where said central axis of said central channel intersects said metal slug;

a central electrode disposed within said central channel where said central electrode is displaced from said tube wall;

a conducting tail where said conducting tail is displaced from said tube wall, where a first portion of said conducting tail is attached within said metal slug and in conductive contact with said metal slug, a second portion of said conducting tail extends between said metal slug and said central electrode, and a third portion of said conducting tail extends within said central electrode and is in conductive contact with said central electrode, and where said central axis of said central channel intersects said first portion of said conducting tail, said second portion of said conducting tail, and said third portion of said conducting tail;

a first conductive plate in conductive contact with said central electrode;

a second conductive plate in conductive contact with said cylindrical metal tube, said method comprising:

applying a current to said cylindrical metal tube through said second conductive plate resulting in said current passing through said metal tube, through said metal slug, through said conducting tail, and through said central electrode causing said conducting tail to break with resultant generation of a plasma along said central axis of said central channel and generation of gas pressure, passing said current through said plasma producing an axial magnetic field which encircles said plasma and inhibits flow of said plasma to said cylindrical metal tube resulting in said plasma formed as a plasma channel separated from said tube wall;

and further wherein said current passes through said plasma producing an electromagnetic force wherein said gas pressure and said electromagnetic force accelerate said metal slug to a high speed greater than or equal to 1000 m/s.

8. The method of claim 7 where the causing of said conductive tail to break comprises accelerating said metal slug sufficiently to mechanically separate said conducting tail and causing said conducting tail to break into a first half attached within said metal slug and a second half in conductive contact with said conducting central electrode, and where the resultant generation of said plasma comprises forming a plasma are between said first half attached within said metal slug and said second half in conductive contact with said conducting central electrode.

9. A system for accelerating solid metal slugs to high speeds comprising:

a cylindrical metal tube having an outer diameter and an inner diameter and having a tube wall between said outer diameter and said inner diameter, where said tube wall surrounds a central channel having a central axis;

a metal slug disposed within said central channel and in conductive contact with said tube wall, where said central axis of said central channel intersects said metal slug;

a conducting central electrode disposed within said central channel where said conducting central electrode is displaced from said tube wall and where some portion of said conducting central electrode surrounds a portion of said central axis, and where said conducting central electrode is disposed within said central channel such that said tube wall surrounds said some portion of said conducting central electrode;

a single conducting tail where said single conducting tail is displaced from said tube wall, and where a first portion of said conducting tail is attached within said metal slug and is in conductive contact with said metal slug, a second portion of said conducting tail extends between said metal slug and said central electrode, and a third portion of said conducting tail extends within said central electrode and in conductive contact with said some portion of said conducting central electrode surrounding said portion of said central axis, and where said central axis of said central channel intersects said first portion of said conducting tail, said second portion of said conducting tail, and said third portion of said conducting tail; and a first conductive plate in conductive contact with said conducting central electrode; a second conductive plate in conductive contact with said cylindrical metal tube;

wherein passing a current through said cylindrical metal tube, through said metal slug, through said conducting tail, and through said central electrode, causes said metal slug to accelerate and the acceleration of said metal slug causing said conducting tail to break into a first half attached within said metal slug and a second half in conductive contact with said conducting central electrode, and said current causing a plasma arc to form between said first half and said second half and along said central axis of said central channel, and said current passing through said plasma arc producing an axial magnetic field which encircles said plasma are and inhibits flow of said plasma arc to said cylindrical metal tube resulting in said plasma arc formed as a plasma channel separated from said tube wall.

10. The system of claim 9 further comprising an insulator disposed within said central channel and surrounding a segment of said central axis, and said insulator separating said central electrode and said tube wall.

* * * * *